US007624547B1

(12) United States Patent
Brinton et al.

(10) Patent No.: US 7,624,547 B1
(45) Date of Patent: Dec. 1, 2009

(54) ACCESSORY KIT FOR A FIXED CURB-MOUNTED SKYLIGHT

(75) Inventors: James Eric Brinton, Greenwood, SC (US); Charles Joseph Rimsky, Greenwood, SC (US); Jeffery Joseph Ronan, Greenwood, SC (US); Christian Aage Lundsgaard, Ry (DK); Per Jacobsen, Horsens (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 12/176,525

(22) Filed: Jul. 21, 2008

(51) Int. Cl.
*E04B 7/18* (2006.01)

(52) U.S. Cl. ..... 52/200; 52/60; 52/198; 52/408

(58) Field of Classification Search ..... 52/58, 52/60, 94, 95, 198, 200, 220.8, 408, 409
See application file for complete search history.

(56) References Cited

U.S. PATENT DOCUMENTS 4,762,160 A 8/1988 Bechtold et al.
5,018,333 A * 5/1991 Bruhm ..... 52/741.4
5,544,455 A 8/1996 DeBlock
5,913,785 A 6/1999 Möller et al.
D432,667 S 10/2000 Möller
6,607,020 B1 8/2003 Jensen
6,640,508 B2 11/2003 Lindgren et al.
7,296,388 B2 * 11/2007 Valentz et al. ..... 52/200

FOREIGN PATENT DOCUMENTS

EP 1857630 A 11/2007
WO 2007110072 4/2007

* cited by examiner

*Primary Examiner*—Richard E Chilcot, Jr.
*Assistant Examiner*—Chi Q Nguyen
(74) *Attorney, Agent, or Firm*—Turner Padget Graham & Laney P.A.

(57) ABSTRACT

Provided herein is an accessory kit for a curb-mounted skylight, including accessory frame members, corner keys, brackets, and an accessory. The frame members, which may have mitered ends, are sized to the dimensions of the skylight opening and are configured to interlock with a corner key element to form an accessory frame. The corner keys are configured to join the frame members at their respective mitered ends and include at least one detent for interlocking with a portion of the accessory frame member. Brackets are also provided for holding an accessory within the accessory frame, and an accessory (for example, blinds or a shade) having end portions complementary to the brackets is also included herein. The accessory kit may further comprise a flexible gasket. The kit may be shipped in an unassembled form and be assembled on-site without the need for tools.

17 Claims, 9 Drawing Sheets

ACCESSORY KIT FOR A FIXED CURB-MOUNTED SKYLIGHT

TECHNICAL FIELD

The present disclosure relates to fixed curb-mounted skylights and, more particularly, to an accessory kit for such skylights. The kit includes accessory frame members, corner keys for interlocking the frame members, brackets for holding the accessory, and an accessory (such as blinds or a shade).

BACKGROUND

Skylights have been used for decades as an architectural element to illuminate interior spaces with natural light. Skylights are of several varieties, including fixed skylights and opening skylights. These assemblies may be further characterized by the manner in which they are mounted to a building rooftop. For example, some skylights are mounted on a pre-assembled curb structure extending from the perimeter of the skylight opening. As such, these skylights are referred to as "curb-mount" skylights. Another type of skylight, the self-flashed skylight, includes an internal curb-like structure as well as a pre-applied flashing surrounding the exterior of the skylight. While reference may be made throughout the present disclosure to curb-mounted skylights, it is anticipated that the present accessory kit may be equally adaptable to self-flashed skylights, if so desired.

In many skylight installations, it may be desirable to control the amount of daylight allowed to illuminate a room. In these instances, a screening device (such as blinds or shades) may be used to block the sunlight entering the room. Depending on the type of screening device, different mounting hardware may be required. In addition to the problem of selecting hardware based on the type of screening device to be used, a problem with installing such hardware may also arise. For instance, the issue may be difficulty reaching the interior portion of the skylight assembly, or the skylight assembly may be configured in such a way as to lack a suitable interior surface for attachment of brackets or other hardware.

Moreover, assembling an accessory tray once the skylight has been installed may prove problematic because of tight tolerances within the existing skylight frame. In addition, if the accessory tray is designed to be installed using hardware such as screws, clips, nails or the like, installation may be considerably more complicated as the installer must juggle the hardware, any necessary tools, and the accessory frame, perhaps at a considerable height.

Accordingly, it would be desirable to have an accessory kit containing the necessary components for complete installation of an accessory tray, which may be easily assembled, without tools, in the field to exacting dimensions and which may be used to hold a variety of different accessories using the same brackets. It would also be desirable that the components of the accessory tray be configured for shipment in separate pieces to reduce shipping costs and to facilitate handling.

SUMMARY

Provided herein is an accessory kit for a curb-mounted skylight, including a plurality of accessory frame members, a plurality of corner keys, a pair of brackets, and an accessory. The frame members, which may have mitered ends, are sized to the dimensions of the skylight opening and are configured to interlock, via the corner keys, to form an accessory frame.

The corner keys are configured to join the frame members at their respective mitered ends and include at least one detent for interlocking with a portion of the accessory frame member. Brackets are also provided for holding an accessory within the accessory frame, and an accessory (for example, blinds or a shade) having end portions complementary to the brackets is also included. The accessory kit may further comprise one or more flexible gaskets to enhance the finished appearance of the skylight. The kit may be shipped in an unassembled form and be assembled on-site without the need for tools.

BRIEF DESCRIPTION OF THE DRAWINGS

A full and detailed disclosure is set forth in the accompanying specification, which makes reference to the appended drawings, in which.

DETAILED DESCRIPTION

Reference is now made to the drawings for illustration of various components of the present accessory kit. It should be noted that, although the skylight assembly is shown as having a substantially flat construction employing flat glass panes, a domed-type skylight covering may instead be employed. The skylight is adapted to span an opening that is generally of square or rectangular shape. The opening may be defined by upright walls that may be part of the roof construction, such walls being referred to as a "curb" or, individually, as "curb members." Further, while the particular illustrations provided herein are directed to a curb-mounted skylight, various elements and embodiments may be equally applicable to self-flashed skylights.

Figure 1:
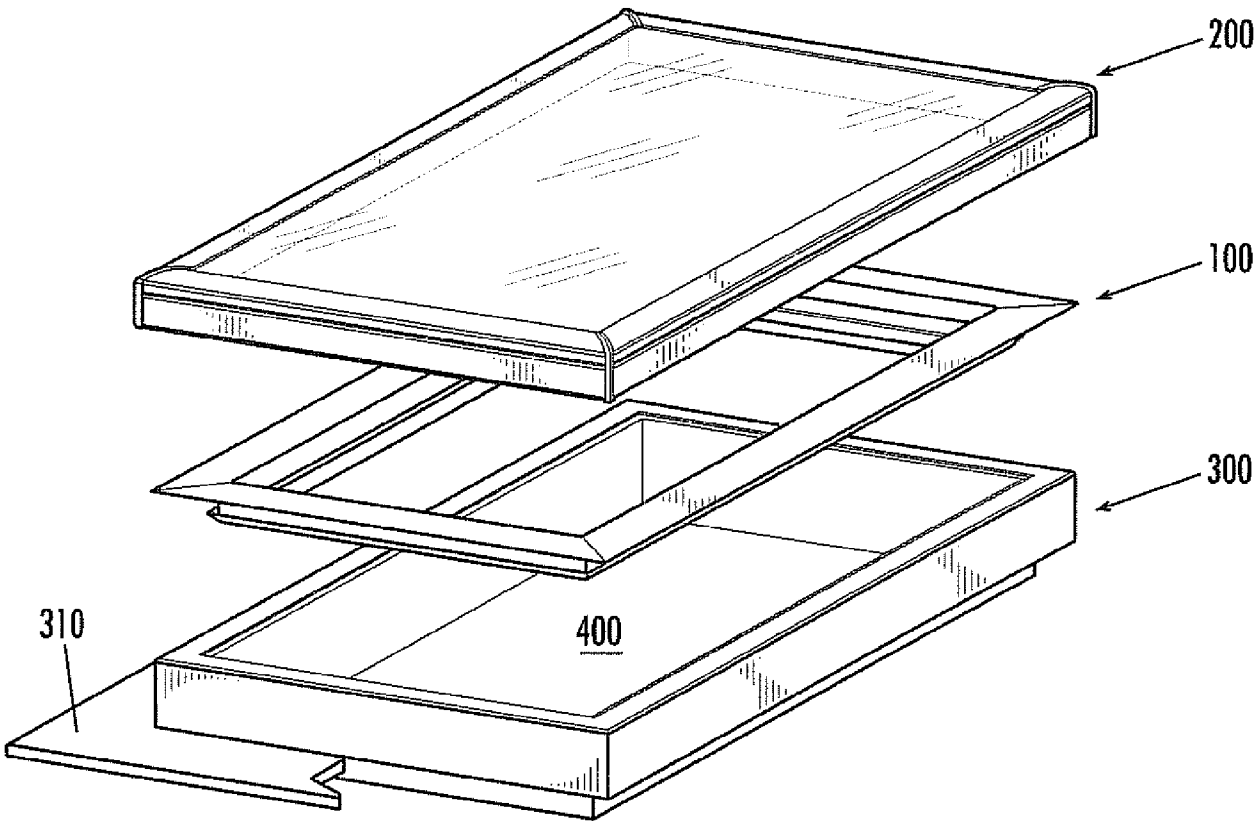
FIG. 1 is an exploded isometric view of a fixed curb-mounted skylight showing the placement of an assembled accessory kit within the skylight assembly.

A fixed curb-mounted skylight assembly, including an accessory kit as provided herein, is shown in FIG. 1. A curb 300 is mounted on a rooftop 310 around an opening 400. The assembled accessory kit 100 (including an accessory frame, corner keys, brackets, and accessory, as described in detail below) may be positioned over the curb 300 during installation of the skylight 200. The frame component of the accessory kit 100 is sized and configured to fit within the curb 300 and be housed by the skylight assembly 200, thereby forming a watertight seal, while maintaining a large, unobstructed opening 400 for passage of light therethrough.

Figure 2:
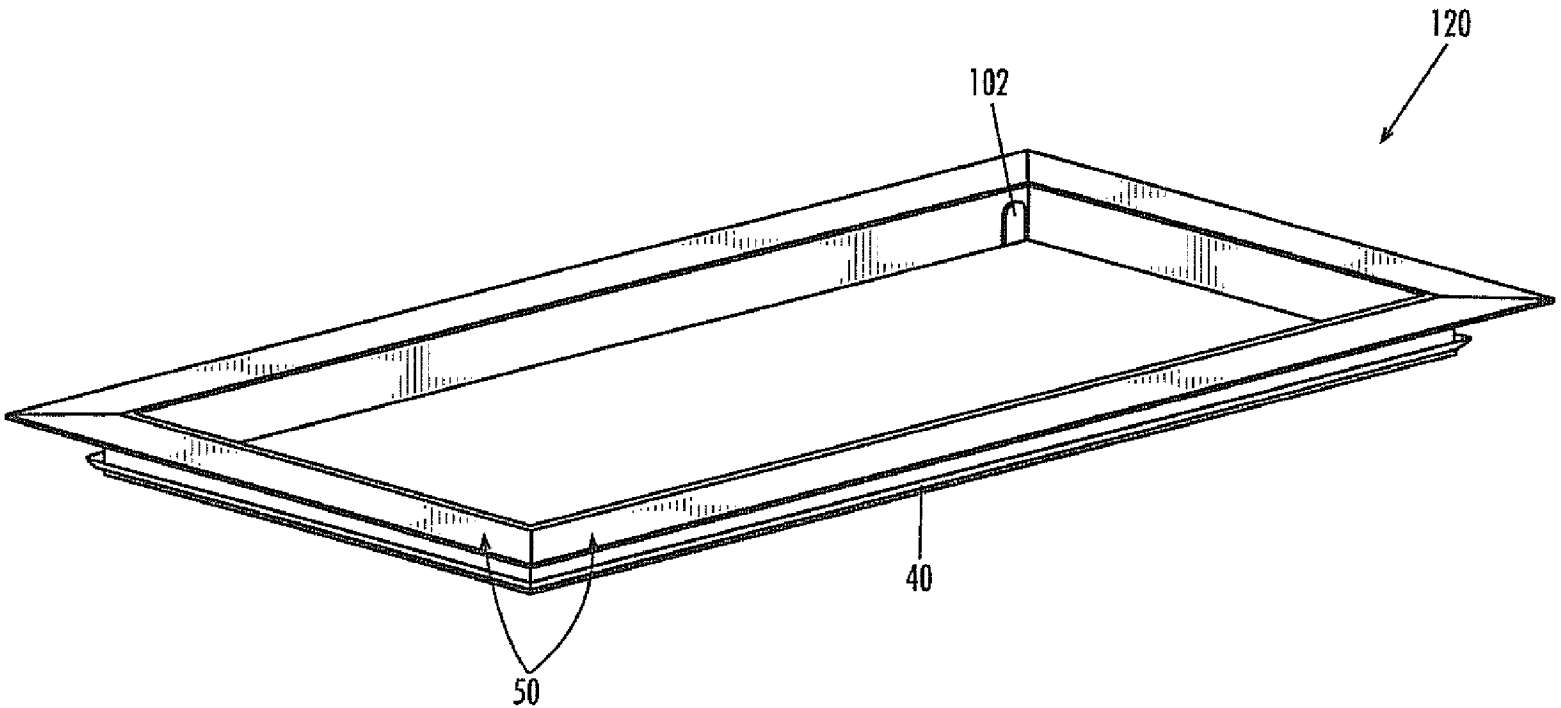
FIG. 2 is an isometric view of an accessory frame of the present disclosure.

FIG. 2 shows the present accessory frame 120 as being of a generally rectangular shape and as having complementary dimensions to those of the skylight assembly 200. Four accessory frame members 50 may be used to form the accessory frame 120, each frame member 50 including mitered ends. Also visible is one of two corner brackets 102 (as shown in greater detail in FIG. 3B) configured for receipt of an accessory, such as blinds or a shade.

Figure 3A:
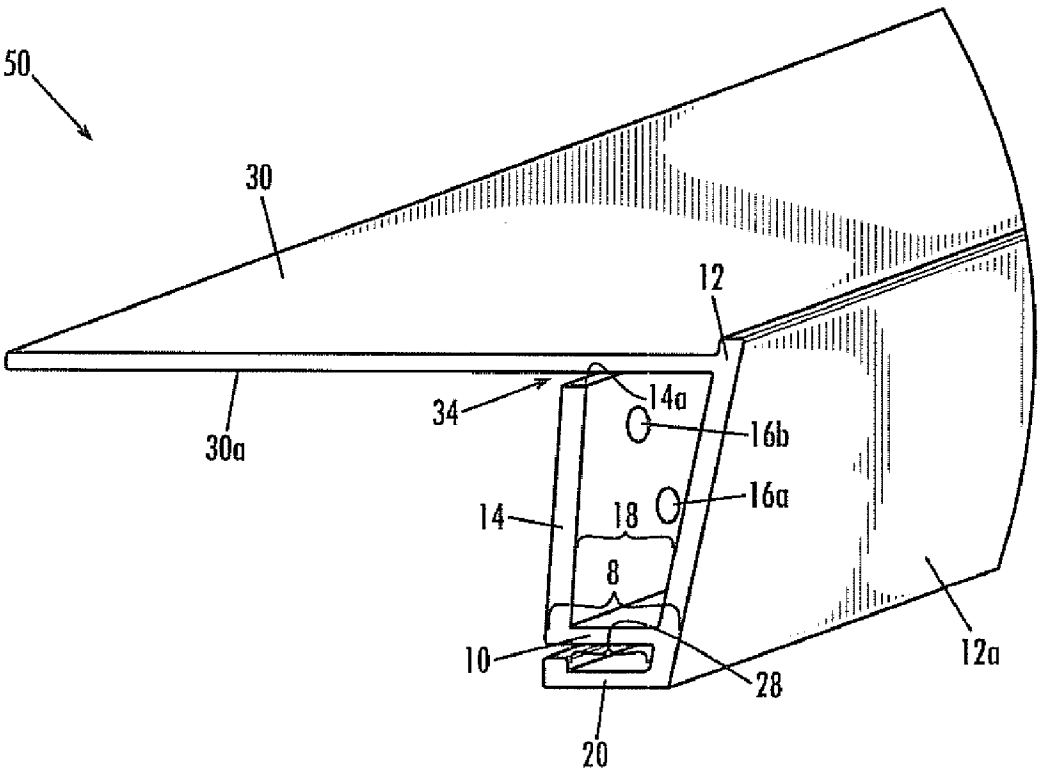
FIG. 3A is a cross-sectional view of an accessory frame member of the accessory frame of FIG. 2, showing an end of the accessory frame member.

A cross-section of the accessory frame member 50, as taken from one end of the frame member 50, may be seen in FIG. 3A. As shown, a horizontal shelf 30 is supported by a U-shaped base 8 formed by a centrally-located plate 10 (substantially parallel to the bottom surface of the horizontal shelf 30) and two upwardly projecting ribs 12, 14. The first rib 12 projects from one edge of the central plate 10, while the second rib 14 projects from the opposite edge of the central plate 10, thereby defining a primary longitudinal channel 18 between the ribs 12, 14.

Figure 4:
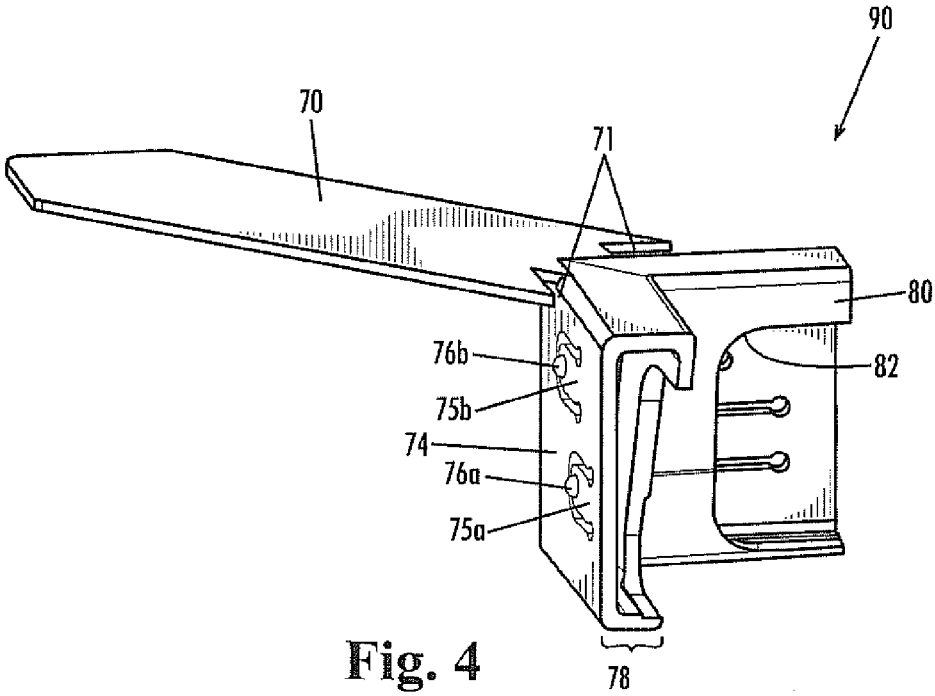
FIG. 4 is a perspective view of an interlocking corner key element, as shown from a first side.

At the end of the frame member 50 where the frame member 50 is joined to a corner key (90, as shown in FIG. 4), the second rib 14 is shorter than the first rib 12, thereby defining a gap 34 between the top edge 14*a* of the second rib 14 and the bottom surface 30*a* of the horizontal shelf 30. This gap 34 may be the result of machining, or otherwise punching, to remove a slot-shaped area from the second rib 14. The second rib 14 also includes a pair of apertures 16*a*, 16*b* therethrough for receipt of interlocking detents found on the corner key (90), as will be discussed further herein. Although two apertures are shown, it is conceivable that another number of apertures (for example, one or more than two) may equally be suitable for this purpose. Alternately, joining mechanisms other than detents and apertures may be used.

A secondary longitudinal channel 28 may also be provided when the first rib 12 and the second rib 14 are extended (in a direction distal to the horizontal shelf 30) and a secondary plate 20 is provided to complete the channel 28. The secondary plate 20 may be oriented in parallel to the central plate 10. In this instance, an opening 24 may be defined through the second rib 14 in the area of the secondary longitudinal channel 28, the opening 24 being configured for passage of a gasket (40, as shown in FIG. 5) therethrough and the secondary longitudinal channel 28 being configured to house the body of the gasket (40).

The interior-facing side 12*a* of the first rib 12 may extend at an angle of about 6 degrees from an imaginary plane perpendicular to and extending from the edge of the horizontal shelf 30. While not required, such angular orientation is suitable for use with a particular, universal bracket system as will be described further below. In addition, it has been found that side 12*a* may have a height of about 50 millimeters (mm) from topmost edge to bottom-most edge (i.e., as measured from where the first rib 12 contacts the secondary plate 20 to a point where the first rib 12 terminates slightly above the edge of the horizontal shelf 30). The 50-mm height has been found to be sufficiently deep to accommodate most accessory hardware.

Figure 3B:
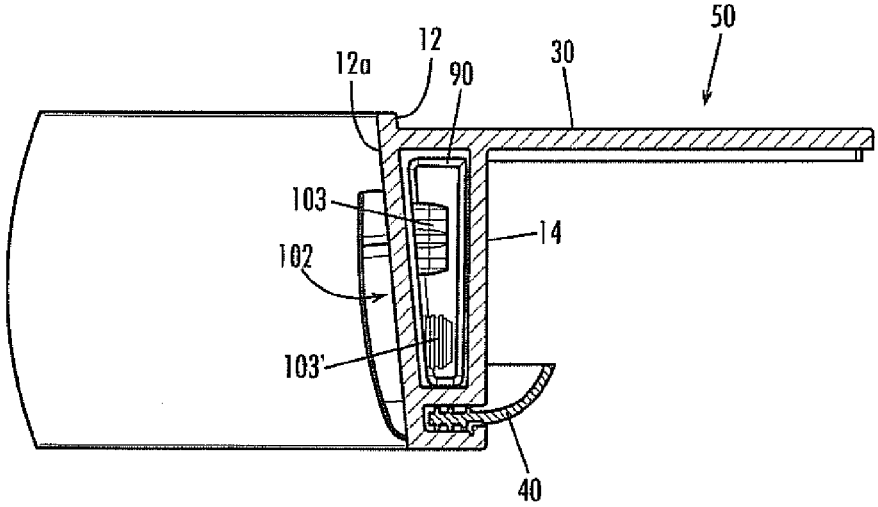
FIG. 3B is a cross-sectional view of an accessory frame member of the accessory frame of FIG. 2, showing an accessory bracket attached to the accessory frame member.
Figure 7:
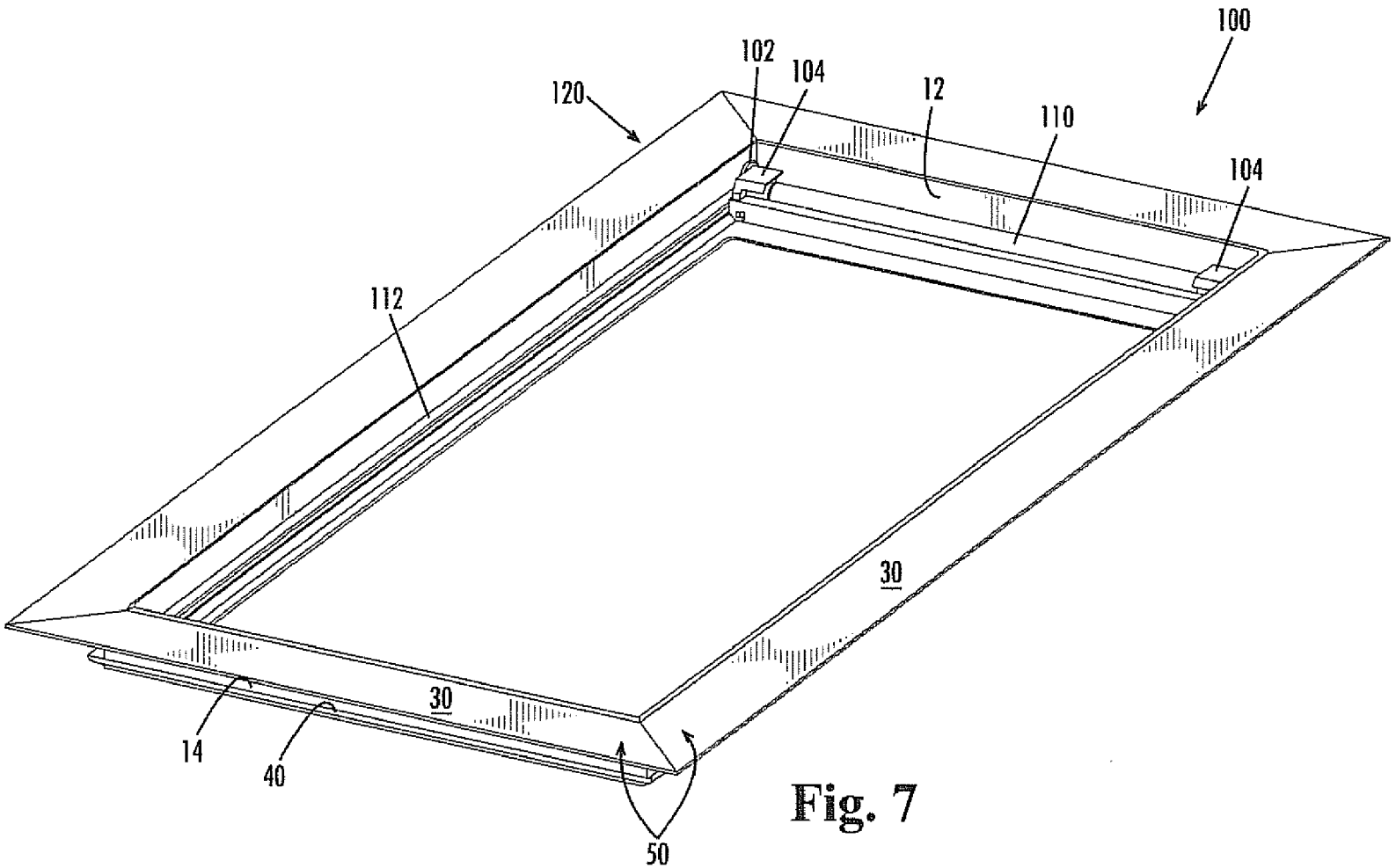
FIG. 7 is an isometric view of the accessory kit of FIG. 1, showing an accessory installed within the accessory frame of FIG. 2.

FIG. 3B illustrates the brackets 102 that are used to engage the mounting hardware 104 of the accessory 110 (such engagement being shown in FIG. 7). The brackets 102 may be of the type in which the cross-sectional dimensions of the bracket 102 increase in the mounting direction over at least a portion of the bracket 102. Such brackets may be described in European Patent Application Publication No. EP 1,857,630 and in International Patent Application Publication No. WO 2007/110072, the disclosures of which are hereby incorporated by reference. The bracket 102, shown in FIGS. 3B and 5 and described in WO 2007/110072, may include a pair of pins 103, 103' that are inserted through correspondingly sized holes (not shown) in the interior-facing surface 12*a* of the accessory frame member 50. At least one of the pins 103, 103' may include a hollow area for housing an electrical terminal, if the accessory (110) is intended to be electrically operated.

Figure 5:
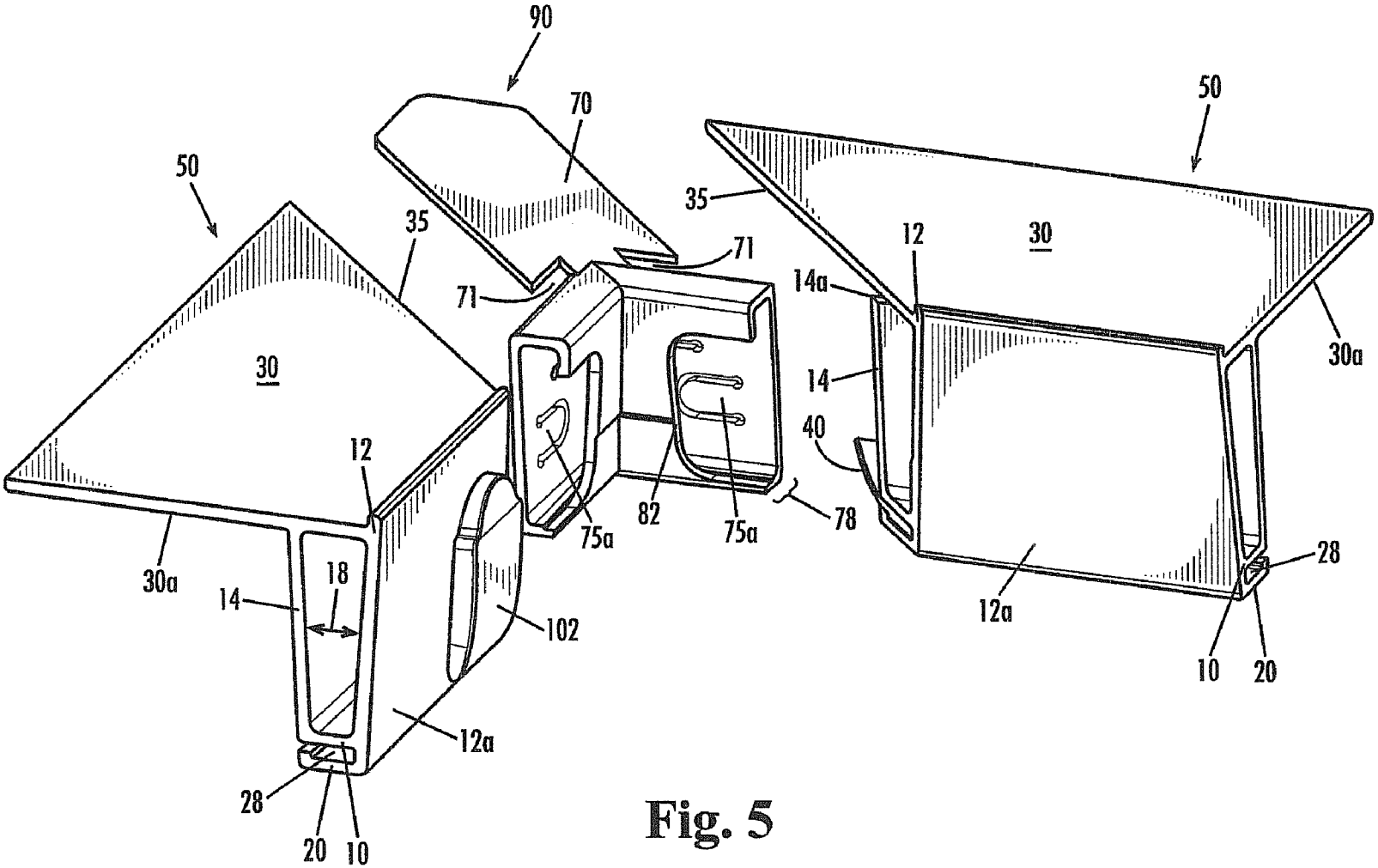
FIG. 5 is an exploded perspective view of two accessory frame members as positioned for joining by the corner key of FIG. 4, as shown from the interior of the accessory frame.

The corner key 90 may be most clearly seen in FIGS. 4 and 5. The corner key 90 includes a pair of perpendicular, vertically extending profiles 78, which together support a horizontal key face 70 that extends over the back of the profiles 78 (rather than over the 90-degree angle formed between the profiles 78). The horizontal key face 70 may be shaped to fit within the gap 34 between the second rib 14 and the horizontal shelf 30 of the frame member 50, as may be seen in FIG. 6. Further, the horizontal key face 70 may include a pair of notches 71 adjacent the vertical profiles 78, each of which engages the gap 34 in a respective adjacent frame member 50 and forms a more robust closure between the corner key 90 and the surrounding frame members 50. The corner key 90 may be made by extrusion or pultrusion, in which fibers are embedded within the component during extrusion.

Each of the vertically extending profiles 78 has a shape complementary to the interior of the primary longitudinal channel 18 of the frame member 50 (such channel 18 being clearly seen in FIG. 3A). The interior-facing sides 80 of the vertical profiles 78 include an opening, or cut-out, 82, which is sized and shaped to accommodate the pins (103, 103') on the back of the brackets (102). Each vertical profile 78 further includes an exterior-facing side 74 on which a pair of detent-carrying tabs 75*a*, 75*b* are located. The tabs 75*a*, 75*b* include respective detents 76*a*, 76*b* that protrude away from the planar surface of the exterior-facing side 74.

Figure 6:
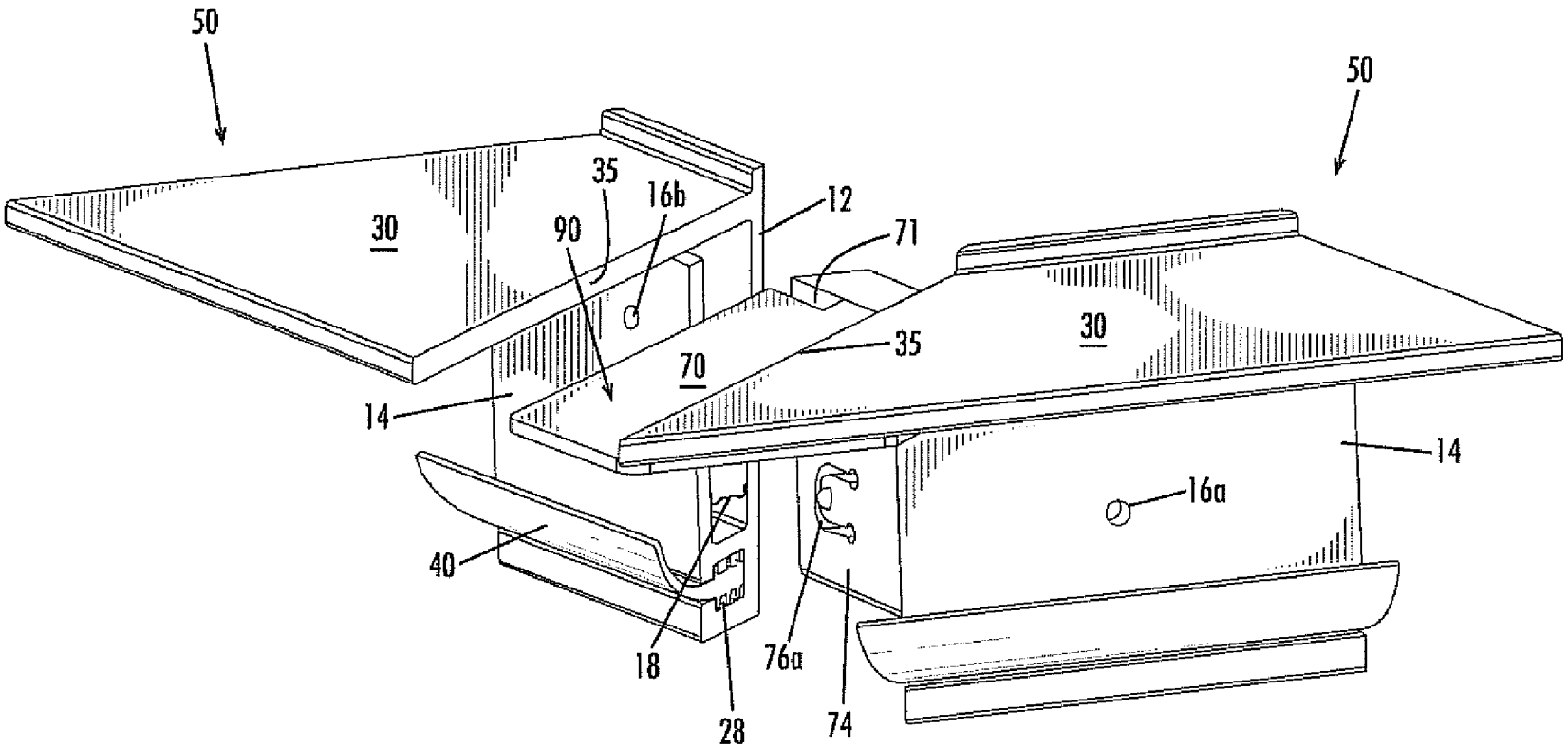
FIG. 6 is an isometric view of two accessory frame members partially joined by the corner key of FIG. 4, as shown from the exterior of the accessory frame.

Such detents 76*a*, 76*b* are sized to engage, and positioned to align with, the apertures 16*a*, 16*b* in the second rib 14 (see, for example, FIGS. 3A and 6). As discussed previously, a single detent or more than two detents may be used in place of the two detents 76*a*, 76*b* shown in FIG. 4, or other joining elements may instead be used. Clearly, an optimum connection may be created by providing the same number of detents as apertures in the second rib 14 of the U-shaped base 8.

The respective ends of two frame members 50 may be tightly secured by means of the above-described interlocking corner key 90, having a slidably engaged horizontal key face 70 and interlocking detents 76*a*, 76*b*. FIG. 5 illustrates the components used to assemble one corner of the accessory frame 120, those being a pair of frame members 50 and the aforementioned corner key 90. As shown, the corner key 90 may be positioned between adjacent frame members 50, such that the vertical profiles (78) of the corner key 90 are aligned with the primary longitudinal channels 18 of the accessory frame members 50.

The accessory frame member 50 on the left side of the drawing includes the bracket 102 attached to the interior surface 12*a* thereof. Accordingly, the interior surface 80 of the corner key 90 includes the cut-out 82, which permits the corner key 90 to be slidably engaged with the frame member 50 without being impeded by the pins (103, 103') on the back of the bracket 102.

Again, it may be noted that the respective mitered ends 35 of the horizontal shelves 30 abut each other to form a plain miter joint, when the corner key 90 is installed, the ends 35 thus covering the horizontal face 70 of the corner key 90. To accommodate the horizontal key face 70, slots are made in the second rib 14 to create a gap (34) between the top 14*a* of the second rib 14 and the bottom 30*a* of the horizontal shelf 30.

Such slots need only be sufficiently long to house the appropriate portion of the key face 70 and need not extend the length of the frame members 50.

As shown in FIG. 6, the corner key 90 engages a first frame member 50 (on the right side of the illustration) when one vertical profile 78 is inserted into the primary longitudinal channel 18 of the frame member 50, and a portion of the horizontal key face 70 is positioned between the top (14*a*) of the second rib 14 and the bottom surface (30*a*) of the horizontal shelf 30 of the frame member 50, as discussed above. The frame member 50 (on the right side of the drawing) has been engaged in such a manner. The joining of the corner keys 90 to the frame members 50 may be accomplished manually and with relative ease, because the components snap together without the necessity for tools, hardware, or other attachment devices (such as adhesive).

The second frame member 50 may be abutted to the first frame member 50 when the other vertical profile (including exterior-facing side 74, visible in FIG. 6) is inserted into the primary longitudinal channel 18 of the second frame member 50, and the exposed horizontal key face 70 is positioned into the gap (34) between the second rib 14 and the horizontal shelf 30 of the second frame member 50. Each frame member 50 includes ends 35 having been cut on an angle to form a plain miter joint between adjacent frame members 50. Using these component parts, the accessory frame (120) may thus be assembled by hand, without the need for any tools.

Further, FIG. 6 illustrates a gasket 40 having been inserted within the secondary longitudinal channel 28 of each frame member 50. While separate gasket members 40 may be used, it should be understood that a single gasket member may be applied to an assembled frame 120 by positioning the gasket 40 around the frame members 50 and inserting the appropriate portion of the gasket within the respective secondary longitudinal channels 28 of the frame members 50. The gasket 40 may be comprised of rubber or a rubber-like material, including, for example, foam rubber.

Referring now to FIG. 7, the present accessory kit 100 is shown in its assembled form, including the assembled accessory frame 120 (as shown in FIG. 2) having an accessory 110 installed therein. The accessory frame 120 has an upper planar surface formed from the four horizontal shelves 30 of the accessory frame members 50, an exterior (or outwardly facing) exposed surface 14 from which one or more gaskets 40 may project, and an interior surface 12 to which the accessory 110 may be secured. The four frame members 50 are connected, at their respective mitered ends, to each other by the corner keys 90 (not shown in this perspective, but as previously described with reference to FIGS. 3A-6).

Brackets 102 (shown, for example, in FIG. 5) engage the mounting hardware 104 of the accessory 110. The accessory 110 may be one of venetian blinds, roller shades, pleated shades, cellular shades, and light blocking shades, or any other type of accessory as may be desired. The exemplary accessory 110 shown in FIG. 7 is a cellular shade in a folded configuration. Further, the accessory 110 may be manually operated or may be electrically operated. To ensure that the accessory 110 remains in close proximity to the covering element 230 (shown in FIG. 9), even when the skylight is installed at a relatively steep angle, a pair of side rails 112 may be installed along the longitudinal sides of the accessory frame 120. The side rails 112 may be made of aluminum, plastic, or any other suitable material.

Figure 8:
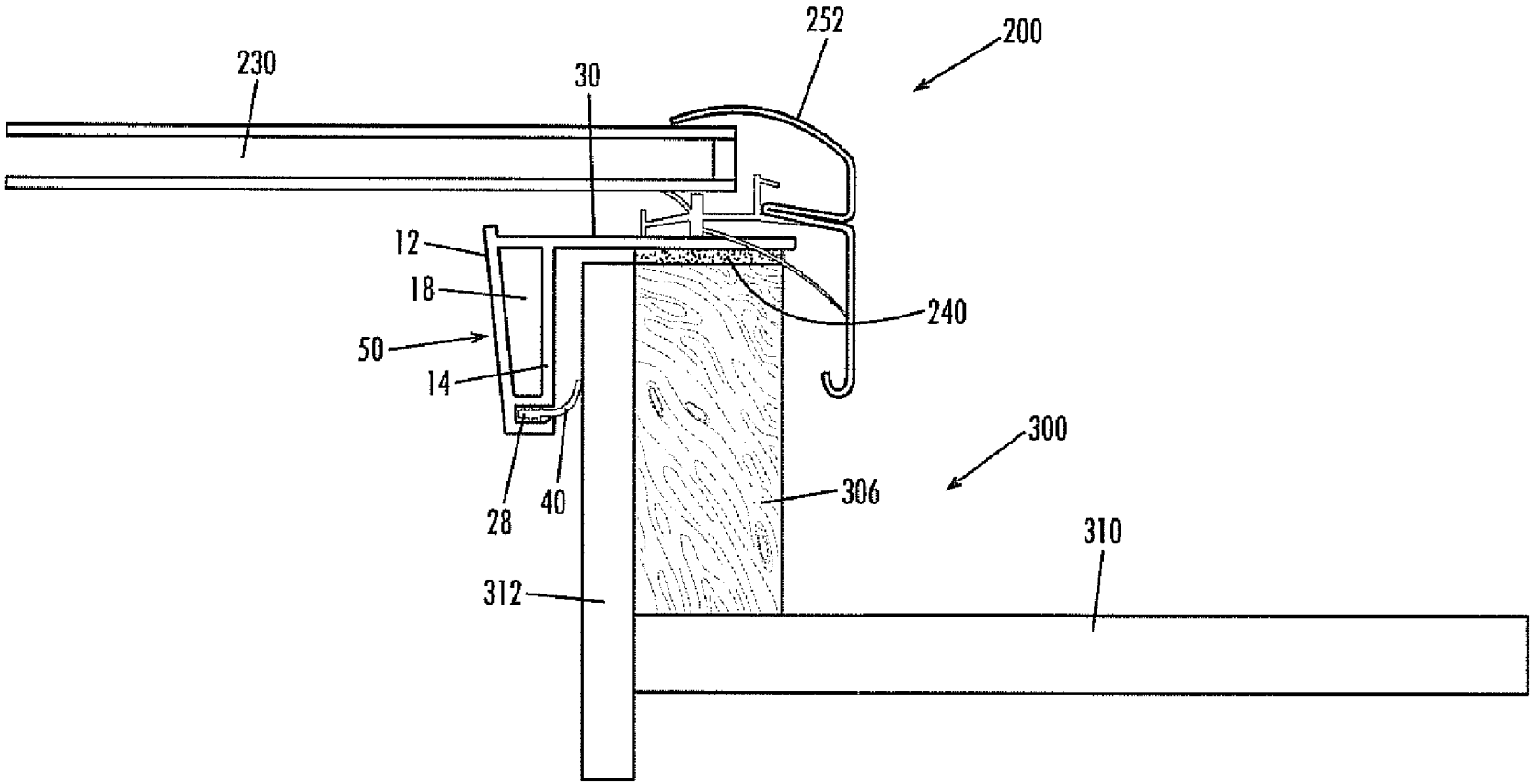
FIG. 8 is a schematic, cross-sectional view of the installed skylight assembly of FIG. 1.

FIG. 8 illustrates, schematically, a cross-section of one side of the present skylight 200, including accessory frame 120, as installed on a curb 300. The skylight 200 includes a covering element 230 that is secured by a sash 252. The sash 252 may rest upon the horizontal shelf 30 of the accessory frame member 50. The accessory frame member 50 is positioned over a curb member 306 mounted to the roof 310, a gasket 240 being positioned therebetween to prevent air and water entry. The interior of the light shaft for the skylight assembly may be finished with a sheetrock panel 312, which is connected to the curb member 306.

Figure 9:
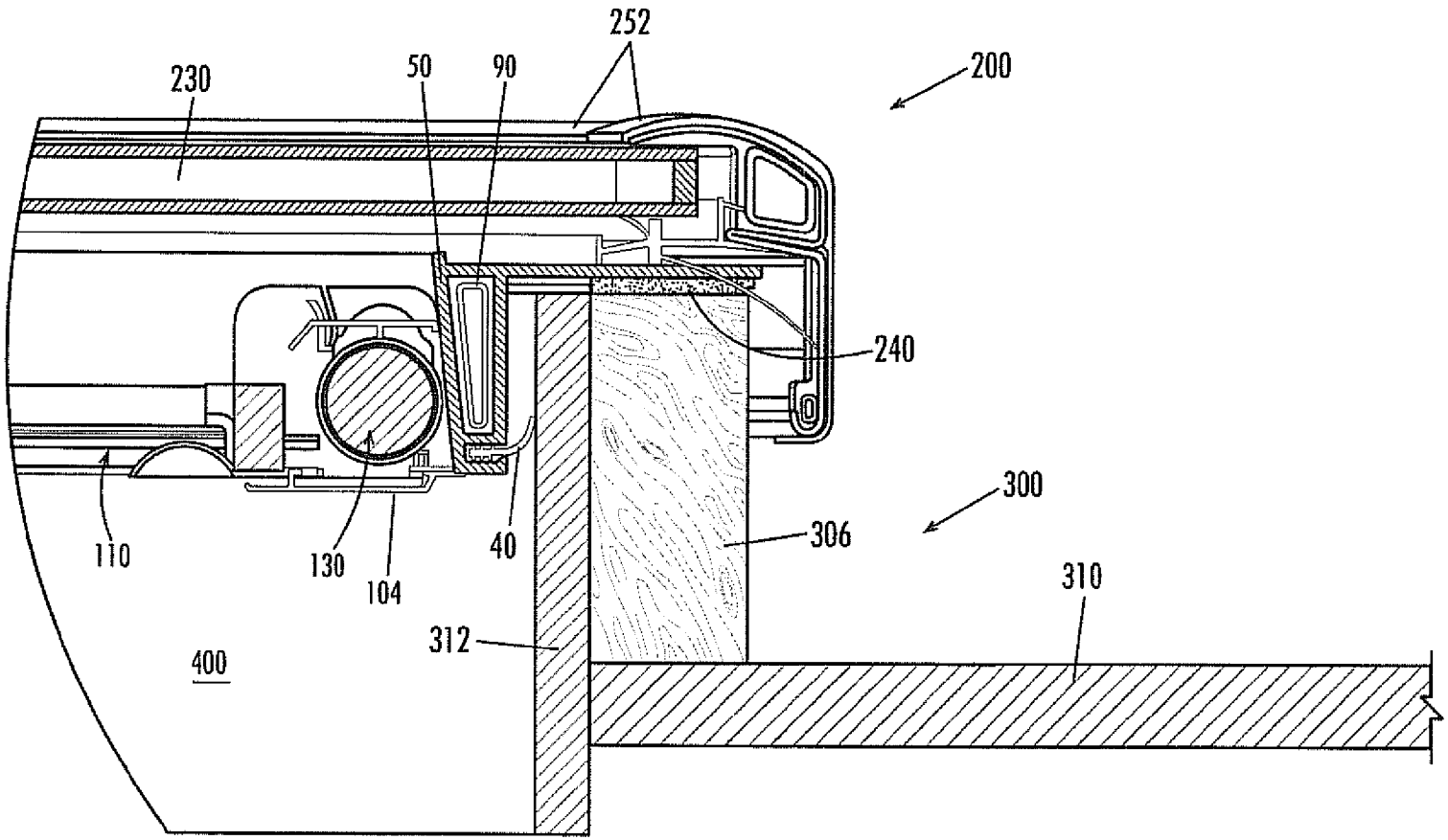
FIG. 9 is a cross-sectional view of the installed skylight assembly of FIG. 1, including the accessory kit.

FIG. 9 shows a more detailed cross-sectional view of the present accessory kit as installed within a skylight 200. The skylight 200 includes the covering element 230 that is secured by the sash 252. The covering element 230 may comprise a single pane of glass or may be a dual-paned glass panel (as shown) or, as mentioned above, may be a dome-shaped panel. One accessory frame member 50, housing the corner key 90 and further having the gasket 40, may be seen adjacent the sheetrock panel 312 and resting on top of the curb member 306. The gasket 240 forms an air and water impermeable seal between the top of the curb member 306 and the horizontal shelf (30) of the accessory frame member 50. The sheetrock panel 312, which provides a finished and aesthetically pleasing surface adjacent the skylight opening 400, may be attached to the curb 306 that projects from the rooftop 310.

An accessory 110 may also been seen in this illustration. As represented in FIG. 7, the accessory 110 is a cellular shade, although other types of shades or blinds may be used. The accessory 110 may be electrically operated, via an electric motor 130, as shown. The brackets (102), which hold the mounting hardware 104, are not visible in this perspective, the view of such brackets being obscured by the electric motor 130 and its housing. The brackets 102 may function as electrical contacts, as well as attachment points, as is described in International Patent Application Publication No. WO 2007/110072, the disclosure of which is hereby incorporated by reference.

The preceding discussion merely illustrates the principles of the present accessory kit, which provides a mechanism for easily mounting an accessory within a fixed curb-mount skylight. It will thus be appreciated that those skilled in the art will be able to devise various arrangements, which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the inventions and the concepts contributed by the inventor(s) to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawings, which are to be considered part of the entire description of the invention. In the description, relative terms such as "lower", "upper", "horizontal "vertical", above", "below", "up", "down", "top" and "bottom", as well as derivatives thereof (e.g., "horizontally", "downwardly", etc.) should be construed to refer to the orientation as then described or as shown in the drawing under discussion. These relative terms are for convenience of description and do not required that the apparatus be constructed or operated in a particular orientation, unless otherwise indicated. Terms concerning attachment, coupling, and the like, such as "connected", "attached", or "interconnected", refer to a relationship wherein structures are secured or attached to one another either directly or indirectly through intervening structures, as well as both movable or rigid attachments or relationships, unless expressly described otherwise.

The foregoing description provides a teaching of the subject matter of the appended claims, including the best mode known at the time of filing, but is in no way intended to preclude foreseeable variations contemplated by those of skill in the art.

We claim:

1. An accessory kit for a fixed curb-mounted skylight, the kit comprising:

a plurality of longitudinal accessory frame members sized and configured to form an accessory frame adjacent to an interior of the skylight, each frame member comprising a generally U-shaped base having a centrally located plate, the central plate having a first edge and a second edge, a first rib projecting from the first edge and a second rib projecting from the second edge, the ribs defining a primary longitudinal channel therebetween;

a horizontal shelf, the shelf characterized as being supported by a base, being integral with the first rib at an end of the first rib distal from the central plate, extending parallel to the central plate over and beyond the second rib, and having ends cut on an angle to form a miter;

wherein, at each end, the second rib is shorter than the first rib to define a gap between the top of the second rib and the bottom of the horizontal shelf and wherein the second rib includes therethrough at least one aperture;

a plurality of corner keys configured to join the frame members at the respective ends of the frame members, each corner key comprising a pair of perpendicular vertically extending profiles, the vertical profiles supporting a horizontal key face, each of the vertical profiles being of a shape complementary to the interior of the primary longitudinal channel of the frame members and having at least one detent sized and positioned to interlock the at least one aperture of the second rib, each horizontal key face being shaped to fit within the gap between the second rib and the horizontal shelf of the frame member;

a pair of brackets for holding an accessory within the accessory frame, the brackets being attached to opposing frame members and being positioned proximate to and equidistant from the respective ends of the opposing frame members; and an accessory, the accessory being sized to fit within the accessory frame and comprising end portions complementary to the brackets.

2. The accessory kit of claim 1, wherein the first rib extends at an angle of about 6 degrees from a perpendicular plane extending from the edge of the horizontal shelf.

3. The accessory kit of claim 1, wherein the first rib extends slightly beyond the edge of the horizontal shelf.

4. The accessory kit of claim 1, wherein the frame members and the corner keys are comprised of plastic.

5. The accessory kit of claim 1, wherein the U-shaped base further comprises a secondary longitudinal channel, the secondary longitudinal channel being located beneath the primary longitudinal channel and comprising an extension of the first and second ribs and a secondary plate, the secondary plate being parallel to the central plate and the second rib defining an opening therethrough in the area of the secondary longitudinal channel.

6. The accessory kit of claim 5, wherein the first rib has a width of about 50 millimeters.

7. The accessory kit of claim 5, further comprising a flexible gasket, the gasket being configured for positioning through the opening of the second rib and within the secondary longitudinal channel of the frame members.

8. The accessory kit of claim 7, wherein the gasket is comprised of rubber.

9. The accessory kit of claim 8, wherein the gasket is comprised of foam rubber.

10. The accessory kit of claim 1, wherein the accessory is selected from the group consisting of roller shades, pleated shades, cellular shades, and light-blocking shades.

11. The accessory kit of claim 1, wherein the accessory is venetian blinds.

12. The accessory kit of claim 1, wherein each vertical profile of each corner key comprises two interlocking detents and each second rib of each frame member defines two correspondingly aligned apertures therethrough.

13. A method of assembling an accessory tray for a fixed curb-mounted skylight, the method comprising:

providing a plurality of longitudinal accessory frame members sized and configured to form an accessory frame adjacent to an interior of the skylight, each frame member comprising a generally U-shaped base having a centrally located plate, the central plate having a first edge and a second edge, a first rib projecting from the first edge and a second rib projecting from the second edge, the ribs defining a primary longitudinal channel therebetween, a horizontal shelf, the shelf characterized as being supported by a base, being integral with the first rib at an end of the first rib distal from the central plate, extending parallel to the central plate over and beyond the second rib, and having ends cut on an angle to form a miter;

wherein, at each end, the second rib is shorter than the first rib to define a gap between the top of the second rib and the bottom of the horizontal shelf and wherein the second rib includes therethrough at least one aperture;

providing a plurality of corner keys configured to join the frame members at the respective ends of the frame members, each corner key comprising a pair of perpendicular vertically extending profiles, the vertical profiles supporting a horizontal key face, each of the vertical profiles being of a shape complementary to the interior of the primary longitudinal channel of the frame members and having at least one detent sized and positioned to interlock the at least one aperture of the second rib, each horizontal key face being shaped to fit within the gap between the second rib and the horizontal shelf of the frame member;

arranging and securing the frame members in a desired shape by inserting the vertically extending profiles of the corner keys into the ends of the frame members, such that the detents on the corner keys interlock the apertures of the second rib and, further, that the horizontal key faces of the corner keys slide into the gap between the top of the second rib and the horizontal shelf of the frame members;

attaching a pair of brackets to opposing frame members at a position proximate to and equidistant from the respective ends of the opposing frame members, the brackets being configured for holding an accessory within the accessory frame;

providing an accessory sized to fit within the accessory frame and comprising end portions complementary to the brackets; and installing the accessory by engaging the end portions of the accessory with the brackets.

14. The method of claim 13, further comprising providing each vertical profile of each corner key with two interlocking detents, and providing each second rib of each frame member with two correspondingly aligned apertures therethrough.

15. The method of claim 13, wherein the accessory is selected from the group consisting of roller shades, pleated shades, cellular shades, and light-blocking shades.

16. The method of claim 13, further comprising providing the U-shaped base with a secondary longitudinal channel, the secondary longitudinal channel being located beneath the primary longitudinal channel and comprising an extension of the first and second ribs and a secondary plate, the secondary plate being parallel to the central plate and the second rib defining an opening therethrough in the area of the secondary longitudinal channel.

17. The method of claim 16, further comprising providing a flexible gasket and positioning the gasket through the opening of the second rib and within the secondary longitudinal channel of the frame members, such that the gasket surrounds the perimeter of the frame members.

* * * * *